US007008460B2

(12) United States Patent
Beurskens et al.

(10) Patent No.: US 7,008,460 B2
(45) Date of Patent: Mar. 7, 2006

(54) PROCESS FOR THE PRODUCTION THERMALLY CONVERTED LIGHT PRODUCTS AND ELECTRICITY

(75) Inventors: Jacobus Henricus Gerardus Beurskens, London (GB); Johannes Didericus De Graaf, Amsterdam (NL); Anthony Malcolm Rigby, Amsterdam (NL)

(73) Assignee: Shell Oil Company, Houston, TX (US)

( * ) Notice: Subject to any disclaimer, the term of this patent is extended or adjusted under 35 U.S.C. 154(b) by 653 days.

(21) Appl. No.: 09/954,331

(22) Filed: Jan. 9, 2002

(65) Prior Publication Data

US 2002/0091166 A1 Jul. 11, 2002

(30) Foreign Application Priority Data

Jan. 10, 2001 (GB) ..... 01300179

(51) Int. Cl.
*C10B 3/00* (2006.01)

(52) U.S. Cl. ..... 48/127.7; 48/198.1; 422/140; 422/146; 422/203; 422/209; 208/86; 208/87

(58) Field of Classification Search ..... 422/140, 422/146, 203, 209; 208/86, 87, 106, 75; 48/127.7, 198.1
See application file for complete search history.

(56) References Cited

U.S. PATENT DOCUMENTS

| | | | | | |
|---|---|---|---|---|---|
| 4,132,065 | A | * | 1/1979 | McGann | 60/780 |
| 4,252,736 | A | * | 2/1981 | Haag et al. | 518/702 |
| 4,308,128 | A | * | 12/1981 | Cummings | 208/86 |
| 4,341,069 | A | * | 7/1982 | Bell et al. | 60/781 |
| 4,432,941 | A | * | 2/1984 | Spencer | 422/140 |
| 4,551,233 | A | * | 11/1985 | Blauwhoff et al. | 208/106 |
| 4,900,429 | A | * | 2/1990 | Richardson | 208/418 |
| 5,132,007 | A | * | 7/1992 | Meyer et al. | 208/427 |
| 5,345,756 | A | * | 9/1994 | Jahnke et al. | 60/781 |
| 5,935,423 | A | | 8/1999 | Crane et al. | 208/348 |
| 6,669,744 | B1 | * | 12/2003 | Allam et al. | 48/127.9 |

FOREIGN PATENT DOCUMENTS

| | | | |
|---|---|---|---|
| EP | 0814146 | * | 12/1997 |
| GB | 2109400 | * | 6/1983 |
| GB | 2338991 A | | 1/2000 |
| WO | WO 97/30011 | * | 8/1997 |

* cited by examiner

*Primary Examiner*—N. Bhat
(74) *Attorney, Agent, or Firm*—Charles W. Stewart

(57) ABSTRACT

Process for the production of thermally converted light products from residual feedstock and electricity from syngas obtained from thermal conversion residue as feedstock, in which process flue gas exiting from the electricity producing unit is fed through a heat recovery unit providing at least part of the heat required in the thermal conversion process.

25 Claims, 2 Drawing Sheets

PROCESS FOR THE PRODUCTION THERMALLY CONVERTED LIGHT PRODUCTS AND ELECTRICITY

The present invention relates to a process for the production of thermally converted light products from residual feedstock and electricity from syngas obtained from thermal conversion residue. The process according to the present invention relates in particular to an integrated process for the production of thermally converted lights products from residual feedstock and electricity from syngas obtained from thermal conversion residue which as such is available from the thermal conversion of residual feedstock into light products.

BACKGROUND OF THE INVENTION

Thermal cracking is widely seen as one of the oldest and well-established processes in conventional refining. The object in conventional refining is to convert a hydrocarbonaceous feedstock into one or more useful products. Depending on feedstock availability and the desired product slate, many hydrocarbon conversion processes have been developed over time. Some processes are non-catalytic such as visbreaking and thermal cracking, others like fluidized catalytic cracking (FCC), hydrocracking and reforming are examples of catalytic processes. The processes referred to herein above have in common that they are geared, and often optimized, to producing transportation fuels such as gasoline and gas oils.

Thermal conversion processes are well known in industry. In particular, the Shell Soaker Visbreaking Process is well known and practiced for many years in many refineries all over the world. For instance, in EPB-7656 a process for the continuous thermal cracking of hydrocarbon oils is described, which has been incorporated herein by way of reference. In this document reference is made to the use of soaker vessels, in particular to soaker vessels containing one or more internals. Preferred configurations comprise up to 20 plates, preferably perforated plates containing round holes having a diameter in the range from 5 to 200 mm. Residence times for the feedstock are suitably in the range from 5 to 60 minutes. Such processes can be carried out upflow or downflow; very good results are normally obtained when operating in upflow mode.

In modern refineries there is a tendency to produce electricity for captive use, or, if appropriate, also for export. Gas turbines are well known units to provide for electricity. Such machines generally consist of an air compressor, one or more combustion chambers in which gas or liquid fuel is burnt under pressure and a turbine in which the hot gases under pressure are expanded to atmospheric pressure. Since the high temperatures of the combustion gases produced would result in serious damage to the turbine blades if they were directed exposed thereto, the combustion gases are normally cooled to an acceptable temperature by mixing them with a large amount of excess air delivered by the compressor. About 65% of the total available power is consumed by the compressor, leaving 35% as useable power. A slight decrease in compressor efficiency reduces the amount of useful power, and, consequently, the overall efficiency considerable. By compressing the air in two stages with an intercooler in between increases the thermal efficiency of the gas turbine. So, the fuel availability is an important factor in optimising any gas turbine efficiency.

An additional constraint to be taken into account with respect to the use of gas turbines lies in the impracticability of using low-grade heavy fuels as feedstocks for gas turbines since turbine parts are easily corroded (even irrespective of the high temperature constraints described herein before) and fouled by sulphur compounds or ash (in particular vanadium compounds) and a very short life between overhauls can then be expected. Gaseous fuels or high-grade distillates seem to be the only practical fuels when continuous operation is necessary.

It is understandable that many efforts have already been devoted to the integration of various refinery operations in order to save costs. This has also been proposed for thermal conversion technology and electricity generation. Reference is made to the recent publication by F. A. M. Schrijvers, P. J. W. M. van den Bosch and B. A. Douwes in Proceedings NPRA, March 1999, San Antonio. In this publication, entitled "Thermal Conversion Technology in Modern Power Integrated Refinery Schemes" it is explained in detail how to integrate a so-called Thermal Gasoil unit with a gas turbine. One of the interesting aspects of such an integration is the use of a heat recovery unit downstream of the gas turbine which allows replacement of the conventional direct fired heater and soaker as well as the recycle heater for distillate.

Although this approach has important advantages compared with the use of conventional equipment, in particular because of the very low average and peak heat fluxes obtainable, it has no impact on the product slate of the thermal cracking operation in which still a large amount of residual material, usually referred to as vacuum flashed cracked residue (VFCR) is produced. Typically a Thermal Gasoil unit will produce between 45 and 65%, especially about 55%, by weight on feed of VFCR.

It would be desirable to use the residual material produced as feedstock for the gas turbine present in the integrated refinery operation. However, there are at least two major problems which prevent the direct use of VFCR as feedstock for the gas turbine. Firstly, VFCR type materials, like any heavy residue, are rich in unwanted sulphur compounds (which have, in essence, accumulated therein when compared with the initial feedstocks) which render them impracticable for duty as gas turbine feed as described herein above. Secondly, in an integrated operation only a very small fraction of the VFCR material produced would be needed (assuming that it did not have other constraints) to run the gas turbine, e.g. in the order of 2–5% by weight on feed which means that the vast majority of residual material would not be required for this duty thus causing a serious mismatch between the two operations to be integrated.

SUMMARY OF THE INVENTION

In view of the above it will be clear that there is an ongoing need not only to improve refinery operations from a product point of view but also from an energy integration point of view and, if possible also with optimal use of by-products and/or bottom streams from an economic point of view.

A method has now been found which allows real integration of a thermal conversion process and a gas turbine delivering electricity by using at least part of the residual material obtained, which as such is unsuitable for duty in a gas turbine, to operate a gasification unit which provides syngas which at least in part can be used directly for duty in the gas turbine thereby maintaining the advantages of the heat recovery system as described herein above whilst producing electricity, and, optionally additional syngas at the same time.

DETAILED DESCRIPTION OF THE INVENTION

Figure 1:
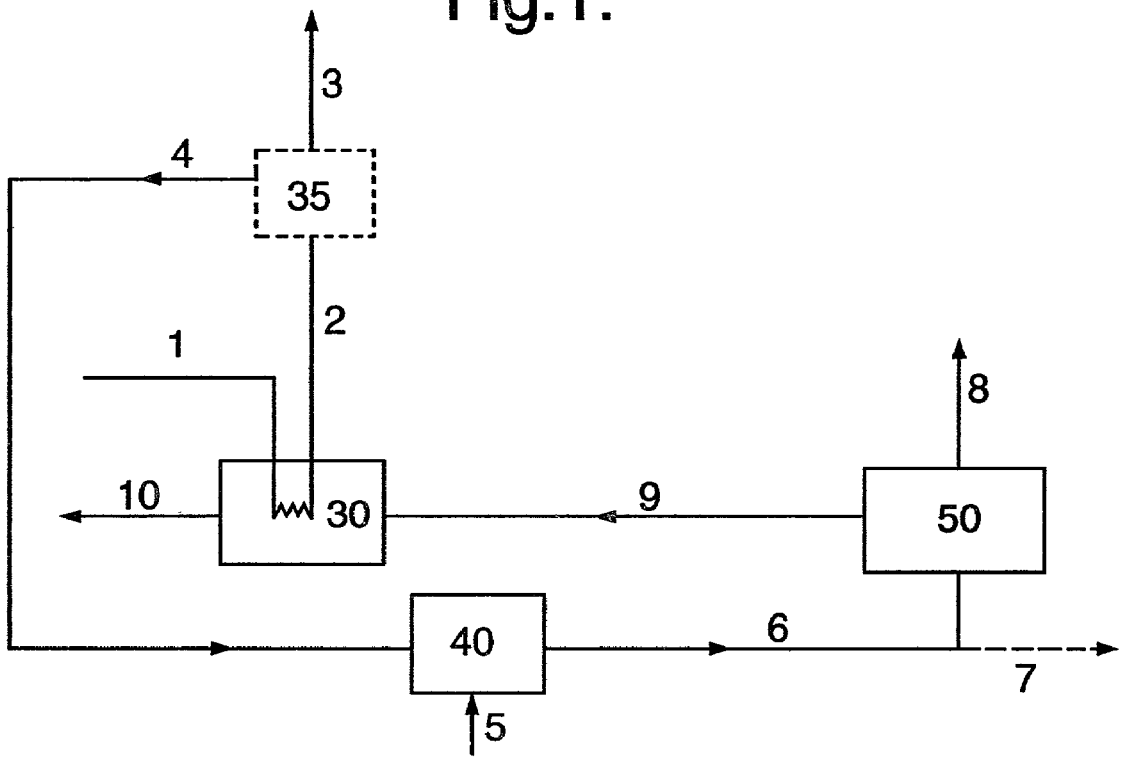
In FIG. 1 the integrated line-up for a heat recovery unit, thermal conversion unit, gasification unit and electricity producing unit is depicted.

The present invention therefore relates to a process for the production of thermally converted light products from residual feedstock and electricity from syngas obtained from thermal conversion residue, in which process flue gas exiting from the electricity producing unit is fed through a heat recovery unit providing at least part of the heat required in the thermal conversion process.

The process according to the present invention relates in particular to an integrated process in which the thermal conversion residue used as feedstock for the production of syngas is obtained at least partially, but preferably in toto, from the residual feedstock producing thermally converted light products.

In addition to the residence time of the feed to be cracked (as described herein above with reference to the Shell Soaker Visbreaking Process), the temperature is an important process variable in thermal cracking. The desirable effect of thermal cracking, i.e. the decrease of molecular weight and viscosity of the feed, arises from the fact that the larger molecules have a higher cracking rate than the smaller molecules. It is known from Sachanen, Conversion of Petroleum, 1948, Chapter 3, that at lower temperatures the difference in cracking rates between larger and smaller molecules increases and, hence, the resultant desirable effect will be greater. At very low temperatures the cracking rate decreases to uneconomically small values. To achieve best results the temperature in the conversion zone is suitably in the range of from 400 to 650° C., preferably in the range between 400 to 550° C., in particular in the range between 420 and 525° C.

The residence time of the oil to be cracked is also influenced by the pressure. Cracking at high pressures will lead to a lower vapor hold-up in the reaction zone thereby increasing the residence time. Cracking at low pressures has a decreasing effect on the residence time of the liquid feed. Suitable pressures are in the range between 2 and 100 bar, preferably in the range between 2 and 65 bar.

The conversion level in the thermal conversion process may be each conversion level which is desired by the overall process. Suitably the conversion to light products boiling below 165° C. may be as low as 2% mass based on the mass of the feed, or as high as 70% mass. The conversion is suitably between 5 and 50% mass based on the mass of the feed, preferably between 10 and 30% mass, more preferably about 20% mass.

Suitable residual feedstocks are heavy hydrocarbonaceous feedstocks having a minimum boiling point of 320° C., especially a minimum boiling point of 350° C., comprising at least 25% by weight of 520° C.+ hydrocarbons (i.e. hydrocarbons having a final boiling point above 520° C.), preferably more than 40% by weight of 520° C.+ hydrocarbons, and even more preferably more than 75% by weight of 520° C.+ hydrocarbons. Feedstocks comprising more than 90% by weight of 520° C.+ hydrocarbons are most advantageously used. Suitable feedstocks thus include atmospheric residues and vacuum residues. If desired, the residual hydrocarbon oil may be blended with a heavy distillate fraction, such as e.g. a cycle oil obtained by catalytic cracking of a hydrocarbon oil fraction, or with a heavy hydrocarbon oil obtained by extraction from a residual hydrocarbon oil.

As regards the production of electricity, it is well known that electricity (as main product and in many cases as the only product) can be produced from a variety of organic feedstocks, ranging from coal and natural gas to oil or residual materials. When using such feedstocks, the aim is at producing electricity as efficiently as possible and hydrocarbonaceous products will not be produced. As described herein above, there are serious constraints when trying to use heavy, sulphur-containing feedstocks directly for duty in a gas turbine. There is no method available for direct conversion of a "cheap dirty calorie" into a "clean calorie". Therefore, at least part of the residual material obtained in the thermal conversion step is to be used as feedstock in a gasification process to put the balance right.

In a gasification process, a hydrocarbonaceous material (ranging from natural gas to coal) is oxidised, in essence, to produce syngas (a mixture of hydrogen and carbon monoxide) which as such can serve as feedstock for many processes. As oxygen source air can be used, although it is preferred to use oxygen enriched air, and even more preferred to use pure oxygen, in view of the higher caloric value per volume unit of the synthesis gas prepared. One outlet for syngas is in processes which need hydrogen as (only) feedstock such as hydrogenation processes or fuel cells which also deliver electricity but which require the absence of carbon monoxide as it acts as a poison to the electrodes necessary in the operation of the fuel cell. When electricity is to be produced by gas turbines, syngas is a preferred feedstock and gasification of residual materials is a very good process to obtain syngas of sufficient quality for this purpose. The process conditions for gasification of residual materials are well known to those skilled in the art. The main steps in the gasification of residual materials are the gasification proper using air as the oxidant followed by cooling of the raw gaseous product, suitably by producing steam when water cooling is applied, a water wash of the cooled syngas product which separates soot from the syngas product and optionally a desulphurisation step to remove gaseous sulphur compounds present in the syngas product.

Having produced electricity from at least part of the syngas provided, e.g. by means of a gas turbine, flue gas will exit from the electricity producing unit. Since the flue gas has a considerable intrinsic heat it is useful to recover as much as possible from the flue gas prior to its release to the environment as process off gas which will at least in part be used to provide at least part of the heat required in the thermal conversion process.

It has been found that heat recoverable from the gas turbine exit can be used advantageously in the integrated thermal conversion/gasification process to heat up the feedstock to be used in the thermal conversion process, even to the extent that the direct heater and the soaker as well as the recycle heater for distillate conversion can be replaced by a heat recovery unit. Since the residue left over after the thermal conversion process is used at least in part and preferably in toto as feedstock for the gasification process to produce syngas a sophisticated heat integration can be achieved. By using a heat recovery unit as envisaged in the process according to the present invention rather than conventionally fired heaters in the thermal conversion process it has become possible to achieve very low average and peak heat fluxes which substantially increase the run lengths normally applicable in thermal conversion units.

A preferred embodiment of the heat recovery unit comprises two recovery banks in series with duct burners installed for the distillate and residue stage sections. These banks are suitably high level heat recovery units for respectively the distillate stage and the residue stage. Optionally, a third heat recovery bank can be present in the heat recovery unit which is suitably a low level heat recovery unit capable of producing medium pressure or superheated steam.

In a preferred embodiment of the process according to the present invention at least 50% and preferably at least 90% of the heat required to sustain the thermal conversion is produced by means of the heat recovery unit. This heat is recovered in a heat recovery unit downstream of the gas turbine producing electricity.

The process according to the present invention will now be illustrated by means of the following non limiting Figures.

In FIG. 1 a residual feedstock is sent via line 1 through heat recovery unit 30 which serves to heat the incoming feedstock thereby allowing some conversion to take place leading to thermally converted light products. The heat necessary to achieve this is provided via line 9. The partially converted feedstock is sent via line 2 to the remainder of the thermal conversion unit 35 (e.g. a soaker or a combi-tower) for further conversion. Depending on the heat supplied in unit 30 it is possible to omit use of unit 35 (i.e. all conversion takes place during the transfer of the residual feedstock through the heat recovery unit 30).

Thermally converted light products are removed via line 3 (or line 2 in case of total conversion) and subjected to further treatment such as distillation (not shown) as appropriate. Thermal residue is sent via line 4 (in the event that unit 35 is used) or as bottom stream from the further processing unit (not shown) to gasification unit 40 which serves to convert thermal residue with the use of air, introduced via line 5 into syngas which is sent via line 6, optionally after removing some of it via line 7 for further uses (not shown) to electricity producing unit 50 (suitably a gas turbine).

Electricity produced in unit 50 is sent to the grid via line 8 and flue gas exiting the electricity producing unit 50 is sent via line 9 to the heat recovery unit 30 to serve as heating medium for the incoming residual feedstock 1. Off gas from the heat recovery unit 30 is released via line 10. If desired, (make-up) thermal conversion residue and/or any other gasifiable material may be sent to gasification unit 40 in addition to residue provided via line 4 (not shown).

Figure 2:
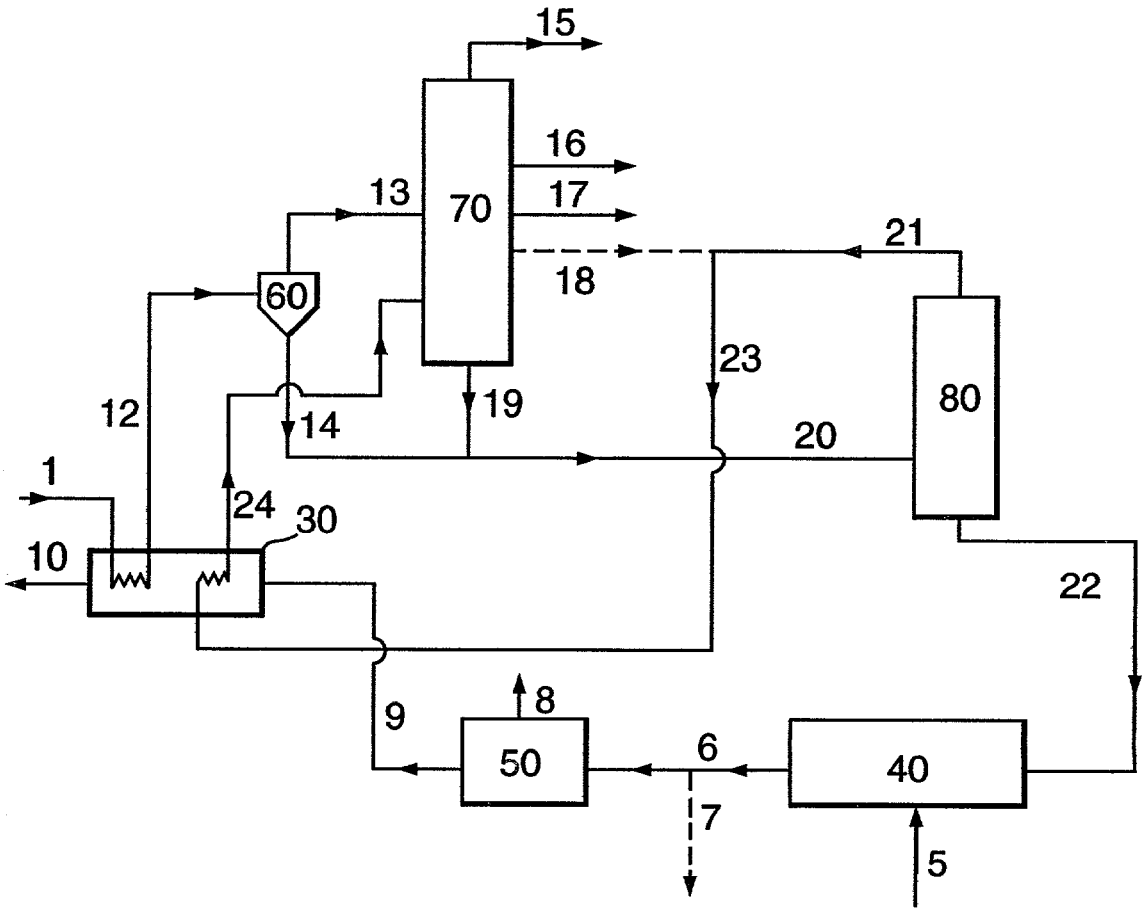
In FIG. 2 a further integrated process line-up is depicted in which part of the produced thermally converted product is subjected to a vacuum flasher to produce more converted product and vacuum residue serving as feedstock for the gasification unit, whilst vacuum flashed material is returned to the combi-tower after transfer through the heat recovery unit.

In FIG. 2 a residual feedstock is sent via line 1 through heat recovery unit 30 which serves in part to heat the incoming feedstock thereby allowing some conversion to take place leading to thermally converted light products. The partially converted feedstock is sent via line 12 to cyclone 60 to allow for separation of heavy material via the bottom of the cyclone which material is sent via lines 14, 19, 20 to vacuum flasher 80. The bulk of the partially converted feedstock is sent via line 13 to combi-tower 70 serving to allow further conversion of (partially converted) residual feedstock as well as allowing separation into a number of products.

Gaseous material is removed from combi-tower 70 via line 15, gasoline via line 16, gas oil via line 17 and optionally a heavy fraction having a boiling range above that of gas oil and not being the bottom stream (which is sent via line 19, together with stream 14 to vacuum flasher 80) via line 18. The bottom stream is sent via lines 19 and 20 to vacuum flasher 80 in which it is separated in a waxy distillate which is recycled, optionally together with the heavy fraction recovered via line 18 to combi-tower 70 via lines 23 and 24 after having passed the heat recovery unit 30 in order to make use of available heat in that unit, thereby allowing some conversion to take place leading to thermally converted light products. The recycle stream 24 enters the combi-tower at a height above the bottom and below the draw off point of the heavy fraction via line 18.

The vacuum residue is sent via line 22 to gasification unit 40 which serves to convert vacuum residue with the use of air, introduced via line 5, into syngas which is sent via line 6, optionally after removing some of it via line 7 for further uses (not shown) to electricity producing unit 50 (preferably a gas turbine).

Electricity produced in unit 50 is sent to the grid via line 8 and flue gas exiting the electricity producing unit 50 is sent via line 9 to heat recovery unit 30 to serve as heating medium for both the incoming thermal residue feedstock to be converted and the waxy distillate to be recycled via lines 21 and 23, optionally together with the heavy fraction recovered from the combi-tower via line 18. Off gas from the heat recovery unit 30 is released via line 10. If desired, (make-up) thermal conversion residue and/or any other gasifiable material may be sent to gasification unit 40 in addition to vacuum residue provided via line 22 (not shown).

Figure 3:
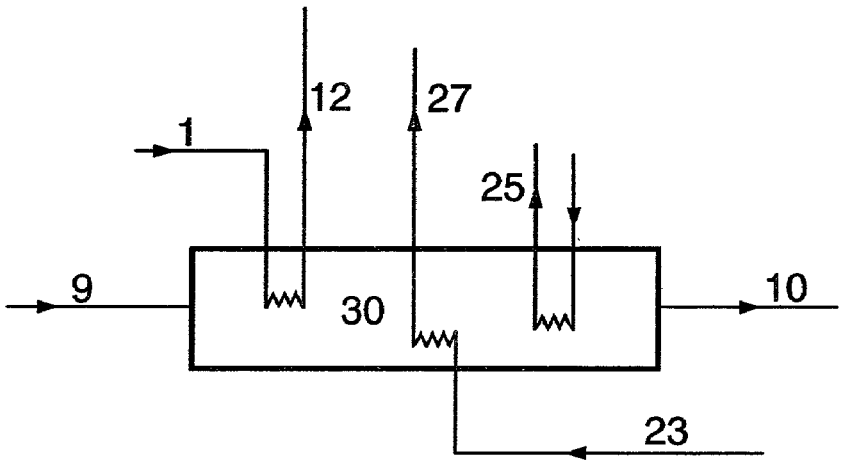
In FIG. 3 a preferred embodiment is depicted of the heat recovery unit which contains three conversion banks to recover high and low level heat.

In FIG. 3 a heat recovery unit to be used in the process according to the present invention is shown schematically. It is described herein below using the reference numerals as given in the description of FIG. 2 as appropriate. The heat recovery unit 30 contains three heat recovery banks serving to supply heat to the incoming residual feedstock via line 1 which is leaving via line 12, to the recycle stream 23 to the combi-tower 70 (not shown) which stream is leaving the unit 30 via line 24, and to a medium pressure steam coil indicated by 25. The first two banks provide high level heat which heats up and partially converts the streams coming in via lines 1 and 23 and the third bank provide low level heat to produce steam via steam coil 25.

The present invention also relates to an integrated system for producing thermally converted light products and electricity comprising a thermal conversion unit to produce thermally converted light products, a gasification unit to produce syngas as feedstock for the production of electricity from thermal residue, an electricity producing unit using syngas as feedstock and a heat recovery unit which is capable of recovering heat from flue gas exiting the electricity producing unit, which heat is available for at least part of the thermal conversion process. Preferably, the heat recovery unit contains three recovery banks, two capable of providing high level heat for the partial conversion of residual feedstock and vacuum residue produced during the conversion process, and a low level recovery bank capable of producing medium pressure steam.

What is claimed is:

1. A process for a thermal conversion of a residual feedstock to produce electricity and a thermally converted light product, said process comprises: obtaining a syngas from a thermal conversion process for said thermal conversion of said residual feedstock; passing a flue gas exiting from an electricity producing unit through a heat recovery unit of said thermal conversion process to thereby provide at least 50 percent of the heat required for said thermal conversion process.

2. A process according to claim 1, in which said heat recovery unit also serves to provide heat for a steam cycle.

3. A process according to claim 2, wherein said thermal conversion process yields a thermal residue as well as said thermally converted light product, and wherein said thermal conversion process further includes a gasification unit for converting said thermal residue to said syngas.

4. Process according to claim 3, in which an atmospheric residue is used as said residual feedstock.

5. Process according to claim 3, in which a vacuum residue is used as said residual feedstock.

6. A process for a thermal conversion of a residual feedstock to produce electricity and a thermally converted light product, said process comprises: passing said residual feedstock to a heat recovery unit whereby said residual feedstock is thermally converted to yield a partially converted feedstock; passing said partially converted feedstock to a cyclone for providing a first bottom stream and a top stream; passing said first bottom stream and said top stream to a system for providing a syngas, wherein said system includes a distillation unit, a vacuum flasher and a gasification unit; and passing said syngas to an electricity production unit whereby electricity is yielded to an electricity grid and whereby a flue gas is yielded from said electricity unit.

7. A process according to claim 6, wherein said top stream is subjected to a distillation treatment within said distillation unit to produce a gasoline fraction, a gas oil fraction and a second bottom stream.

8. A process according to claim 6, in which said second bottom stream is subjected to a treatment within said vacuum flasher under reduced pressure to obtain a waxy distillate and a third bottom stream.

9. A process according to claim 8, in which said first bottom stream is subjected to said treatment within said vacuum flasher under reduced pressure to obtain said waxy distillate and said third bottom stream, and further said third bottom stream is passed to said gasification unit that provides for the conversion of said third bottom stream to said syngas.

10. A process according to claim 9, in which at least part of said waxy distillate is passed to said heat recovery unit to subject it to heat treatment prior to its recycle to the bottom of said distillation unit.

11. A process according to claim 10, in which a heavy fraction having a boiling range above that of said gas oil fraction and not being the second bottom stream is passed to said heat recovery unit to subject to a second heat treatment prior to its recycle to the bottom of said distillation unit.

12. A process according to claim 11, in which said waxy distillate is passed through said heat recovery unit prior to the recycle and introduction into the bottom of said distillation unit.

13. A process according to claim 11, wherein said electricity production unit includes a gas turbine by which electricity is produced and from which said flue gas is sent to said heat recovery unit which contains at least two heat recovery banks.

14. Process according to claim 13, in which said heat recovery unit additionally contains a low level heat recovery unit.

15. A process for a thermal conversion of a residual feedstock to produce electricity and a thermally converted light product, said process comprises: passing said residual feedstock through a heat recovery system, thereby allowing an initial conversion of said residual feedstock to a partially converted feedstock; passing said partially converted feedstock through a cyclone from which a first bottom stream and a top stream are recovered; sending said top stream to a distillation unit by which a gasoline fraction, a gas oil fraction, a thermal conversion residue and a second bottom stream are obtained; subjecting at least part of said thermal conversion residue to a gasification process unit to obtain a syngas; sending said syngas to a gas turbine to produce electricity whilst the flue gas exiting said gas turbine is passed through said heat recovery system to recover heat which is used at least partly for said initial conversion of said residual feedstock.

16. Process according to claim 15, in which said second bottom stream of said distillation unit is subjected to a treatment under reduced pressure to provide a waxy distillate and a vacuum residue and wherein said waxy distillate is passed to said heat recovery system in which it is subjected to a heat treatment and therefrom passed to the bottom of said distillation unit.

17. A process, comprising:

passing a residual feedstock to a heat recovery unit whereby at least a portion of said residual feedstock is thermally converted to yield a partially converted feedstock;

passing said partially converted feedstock to a system for processing said partially converted feedstock to yield electricity and a fluegas; and passing to said heat recovery unit said flue gas which serves as a heating medium.

18. A process as recited in claim 17, wherein said system further includes a cyclone that provides for the separation of said partially converted feedstock into a heavy material and a remaining material.

19. A process as recited in claim 18, wherein said system further includes a combi-tower for the conversion of said remaining material and for the separation of the thus-converted remaining material into a gasoline material, a gas oil, a heavy fraction, and a bottom stream.

20. A process as recited in claim 19, wherein said system further includes a vacuum flasher that provides for the separation of said bottom stream into a waxy distillate and a vacuum residue.

21. A process as recited in claim 20, wherein said system further includes a gasification unit that provides for the conversion of said vacuum residue to a syngas.

22. A process as recited in claim 21, wherein said system further includes a electricity production unit that provides for utilizing said syngas to yield said electricity to a grid and to yield said flue gas.

23. A process as recited in claim 22, further comprising recycling said waxy distillate to said heat recovery unit wherein which said waxy distillate provides heat energy and passing said waxy distillate from said heat recovery unit to said combi-tower.

24. A process as recited in claim 23, further comprising passing said heavy material to said vacuum flasher.

25. A process, comprising:

passing a residual feedstock to a heat recovery unit whereby at least a portion of said residual feedstock is thermally converted to yield a partially converted feedstock comprising light products and a thermal residue;

separating said light products and said thermal residue of said partially converted feedstock to yield at least a separated thermal residue;

passing said separated thermal residue to a gasification unit whereby said separated thermal residue is converted into a syngas;

passing said syngas to an electricity production unit whereby electricity is yielded to an electricity grid, and whereby a fluegas is yielded from said electricity production unit; and passing said fluegas to said heat recovery unit in which said fluegas is used as a heating medium.

* * * * *